US011505428B2

(12) United States Patent
Walker

(10) Patent No.: US 11,505,428 B2
(45) Date of Patent: Nov. 22, 2022

(54) DEVICE AND METHOD FOR MONITORING A MAINTENANCE MODE OF AN ELEVATOR INSTALLATION

(71) Applicant: Inventio AG, Hergiswil (CH)

(72) Inventor: Markus Walker, Ziefen (CH)

(73) Assignee: INVENTIO AG, Hergiswil NW (CH)

( * ) Notice: Subject to any disclaimer, the term of this patent is extended or adjusted under 35 U.S.C. 154(b) by 738 days.

(21) Appl. No.: 15/758,530

(22) PCT Filed: Sep. 9, 2016

(86) PCT No.: PCT/EP2016/071245

§ 371 (c)(1),
(2) Date: Mar. 8, 2018

(87) PCT Pub. No.: WO2017/042306

PCT Pub. Date: Mar. 16, 2017

(65) Prior Publication Data

US 2018/0244496 A1 Aug. 30, 2018

(30) Foreign Application Priority Data

Sep. 11, 2015 (EP) ..... 15184820

(51) Int. Cl.
*B66B 1/34* (2006.01)
*B66B 1/46* (2006.01)
(Continued)

(52) U.S. Cl.
CPC ..... *B66B 5/0087* (2013.01); *B66B 1/3407* (2013.01); *B66B 1/3415* (2013.01); *B66B 3/002* (2013.01); *B66B 2201/00* (2013.01)

(58) Field of Classification Search
USPC ..... 187/247
See application file for complete search history.

(56) References Cited

U.S. PATENT DOCUMENTS 6,357,553 B1 3/2002 Vialonga
7,344,004 B2 * 3/2008 Engel ..... B66B 1/34 187/391
(Continued)

FOREIGN PATENT DOCUMENTS

EP 1110900 A1 6/2001
EP 2033927 A1 11/2009
(Continued)

OTHER PUBLICATIONS

The American Society of Mechanical Engineers, ASME A17.1-2013/CSA B44-13 Safety Code for Elevators and Escalators, Oct. 21, 2013, pp. 47, 48, 111 and 112, ASME, USA.

*Primary Examiner* — Christopher Uhlir
(74) *Attorney, Agent, or Firm* — William J. Clemens; Shumaker, Loop & Kendrick, LLP

(57) ABSTRACT

A control unit, an elevator-monitoring apparatus and a method are used to monitor a maintenance mode of an elevator installation. The control unit has a controller and a memory device, wherein the controller receives a first signal when a locking device of shaft door is locked and receives a second signal when the locking device is unlocked. The controller compares a chronological signal sequence of first signals and second signals with a reference sequence stored in the memory device for actuation of the locking device and, if the signal sequence of the first signals and second signals matches the reference sequence, ends the maintenance mode and releases a car of the elevator installation for a traveling operation.

19 Claims, 3 Drawing Sheets

S1 MULTIPLE SUCCESSIVE INSTANCES OF ACTUATION OF THE LOCKING DEVICE
S1' GENERATE FURTHER SIGNAL SEQUENCE
S2 COMPARING CHRONOLOGICAL SIGNAL SEQUENCE
S3 RELEASING THE CAR FOR DRIVING OPERATION

(51) Int. Cl.
*B66B 5/00* (2006.01)
*B66B 3/00* (2006.01)

(56) References Cited

U.S. PATENT DOCUMENTS

| | | | | |
|---|---|---|---|---|
| 8,602,171 | B2 * | 12/2013 | Vogl | B66B 5/0087 187/380 |
| 9,422,135 | B2 * | 8/2016 | Rogers | B66B 5/0031 |
| 2003/0094332 | A1 | 5/2003 | Tinone et al. | |
| 2008/0047783 | A1 | 2/2008 | Vogl | |
| 2017/0297868 | A1 * | 10/2017 | Aitamurto | E05B 17/22 |

FOREIGN PATENT DOCUMENTS

| | | | |
|---|---|---|---|
| EP | 3056460 | A1 | 8/2016 |
| WO | 0051929 | A1 | 9/2000 |
| WO | 03024856 | A1 | 3/2003 |
| WO | 200804022 | A1 | 1/2008 |
| WO | 2014016135 | A1 | 1/2014 |

* cited by examiner

10 CONTROL UNIT 11 INTERFACE 12 CONTROLLER 13 INTERFACE
14 MEMORY DEVICE 16 SHAFT DOOR 18 LOCKING DEVICE
20 SENSOR ELEMENT 21 SWITCH 22 LOCK
100 ELEVATOR INSTALLATION

10 CONTROL UNIT 11 INTERFACE 12 CONTROLLER 14 MEMORY DEVICE 16 SHAFT DOOR
18 LOCKING DEVICE 20 SENSOR ELEMENT 21 SWITCH 24 SAFETY SWITCH
50 ELEVATOR-MONITORING APPARATUS 52 CAR 54 ELEVATOR SHAFT
56 SAFETY CHAIN 58 DRIVE 60 MAINTENANCE SWITCH 62 SIGNAL GENERATOR
64 DEVICE FOR STORING/RESETTING THE REFERENCE SEQUENCE
100 ELEVATOR INSTALLATION

S1 MULTIPLE SUCCESSIVE INSTANCES OF ACTUATION OF THE LOCKING DEVICE
S1' GENERATE FURTHER SIGNAL SEQUENCE
S2 COMPARING CHRONOLOGICAL SIGNAL SEQUENCE
S3 RELEASING THE CAR FOR DRIVING OPERATION

DEVICE AND METHOD FOR MONITORING A MAINTENANCE MODE OF AN ELEVATOR INSTALLATION

FIELD

The present invention relates to elevator installations in general. In particular, the present invention relates to a control unit, an elevator-monitoring apparatus for monitoring a maintenance mode of an elevator installation, and a method for ending a maintenance mode of an elevator installation.

BACKGROUND

An elevator installation may have components of the elevator installation that are ready for maintenance and/or require maintenance, especially under a car that can be moved in an elevator shaft between floors of a building. These components may be arranged, for example, on an underside of the car and/or within the elevator shaft.

When such components are to undergo maintenance, the elevator installation may generally be transferred to a maintenance mode, in which operation of the car can be locked, or in which the car can only be moved between certain positions within the elevator shaft and/or between certain floors.

For example, personnel, in order to perform maintenance work, may access the elevator shaft via a shaft door of the elevator installation and/or via a maintenance hatch, wherein a maintenance switch—which may be located, for example, next to the particular shaft door or the maintenance hatch, and/or on a car roof—can be actuated, e.g., activated before the elevator shaft is entered. The maintenance hatch may generally refer, for example, to a maintenance access and/or a maintenance door. The shaft door and/or the maintenance hatch may be coupled to a safety switch of a safety chain of the elevator installation, so that operation of the car can be blocked on opening or unlocking of the shaft door and/or the maintenance hatch, for example, by interruption a power supply to a drive of the car. Actuating the maintenance switch furthermore makes it possible to switch the elevator installation to the maintenance mode. The maintenance switch may refer, for example, to an emergency brake switch which, when activated, can interrupt the safety chain and, for example, stop door movements. Alternatively or additionally, the maintenance switch may refer to an inspection switch, which, when activated, can interrupt the safety chain and/or activate another branch of the safety chain, so that movements of the car and/or door movements can be prevented.

After completion of the maintenance work and after departure from the elevator shaft, the maintenance switch can be actuated, e.g., deactivated, to end the maintenance mode, and the shaft door can be closed/locked and concomitantly the safety chain can be closed to transfer the elevator installation to regular travel operation in which the car can be movable.

EP 2033927 A1 describes an elevator installation with a safety chain that has a normal operation branch having a first safety switch for enabling a supply of a drive with electrical energy, and an inspection operation branch that is designed to enable supplying of the drive with electrical energy during maintenance work.

There may be, inter alia, a need for a safety measure with which it can be ensured that personnel have left the elevator shaft after maintenance work and before commencement of the regular driving operation of the elevator installation.

SUMMARY

One aspect of the invention proposes a control unit for monitoring a maintenance mode of an elevator installation that has a controller and a memory device. The controller is designed to receive a first signal when a locking device of a shaft door of the elevator installation—via which an elevator shaft of the elevator installation can be accessed for maintenance work—is locked, and to receive a second signal when the locking device is unlocked. The controller is also designed to compare a chronological signal sequence of first signals and second signals with a reference sequence stored in the memory device for actuation of the locking device, wherein the controller is furthermore designed to end the maintenance mode and to release a car of the elevator installation for a traveling operation if the signal sequence of the first signals and second signals matches the reference sequence. The first signal and the second signal maybe regarded as different or separate signals, or as states or parts of a single signal.

The reference sequence for an actuation of the locking device may denote, for example, a reference sequence of the expected signal sequence of first and second signals in the case of multiple consecutive instances of locking and unlocking of the locking device. The reference sequence may thus, for example, map and/or represent a definable actuation pattern of the locking device, which may represent a chronological series or sequence of locking and unlocking operations of the locking device and/or correlate with this sequence. When the personnel leave the elevator shaft after maintenance and/or a shaft inspection, then they can operate the locking device according to and/or analogously to the actuation pattern defined or stored in the reference sequence, for example, by multiple successive instances of locking and unlocking of the locking device. This makes it possible for the chronological signal sequence of first signals—which may each correspond, for example, to a locking signal of the locking device—and second signals—which may each correspond, for example, to an unlocking signal—to be generated and/or produced and received from the controller of the control unit. The controller can then compare the received signal sequence with the reference sequence, and terminate the maintenance mode if there is a match. Optionally, the controller may therefor at least partially store the signal sequence of received first and/or second signals in the memory device. Also, the controller may further process and/or process the first and/or second signals for the comparison with the reference sequence.

The design of the control unit according to the invention makes it possible to ensure in an advantageous manner that no personnel are in the elevator shaft anymore for maintenance work, as they have repeatedly actuated the locking device of the shaft door that is arranged outside of the elevator shaft. Accordingly, it can be ensured by the control unit according to the invention that the maintenance mode of the elevator installation can be ended and the regular driving operation can be resumed. Such a safety function or safety measure provided by the control unit according to the invention can serve to implement the safety standard EN 81-20:2014 for elevator installations, which provides for equipping elevator installations with a device arranged outside the elevator shaft in order to end the maintenance mode.

Furthermore, a locking device for locking and unlocking or closing and opening the shaft door that is designed as a lock coupled to a sensor element is usually arranged on most shaft doors. The lock can generally be actuated by the personnel with a key, such as a triangular key. The control unit according to the invention can thus advantageously be retrofitted quickly and cost-effectively. In particular, the control unit according to the invention can be retrofitted without attaching further operating elements to the elevator installation and/or without further adaptation of the elevator installation, or can be installed in newly-manufactured elevator installations, i.e., regardless of the type and/or a design of the elevator installation. Thus, for example, customer wishes regarding the appearance of the elevator installation, in particular the shaft doors and/or the car, can be implemented flexibly and without visible adaptation of the elevator installation.

The controller of the control unit may generally designate a logic device. For example, the controller may designate and/or include a microcontroller, a processor, a Field Programmable Gate Array (FPGA), and/or any other programmable data processing device. The controller may be implemented and/or appropriately set up, for example, programmed, for all of the functions set forth above and below. For this purpose, the controller can access corresponding instructions stored in a program code.

The memory device may refer to any device for storing and/or retrieving data, and may have, for example, a disk, a hard drive, a USB storage device, a random access memory (RAM), a read-only memory (ROM), a FLASH memory, and/or an erasable programmable read-only memory (EPROM).

Another aspect of the invention relates to an elevator-monitoring apparatus having a control unit as described above and below.

It is understood that features of the control unit as described in the foregoing and in the following may also be features of the elevator-monitoring apparatus and vice versa.

Another aspect of the invention relates to a method for ending a maintenance mode of the elevator installation.

It is understood that features of the method as described in the foregoing and in the following may also be features of the control unit and/or the elevator-monitoring apparatus and vice versa.

According to one embodiment of the invention, the reference sequence comprises a chronological sequence of first signal, second signal, first signal, second signal, and first signal, or the reference sequence comprises a time chronological sequence of second signal, first signal, second signal, first signal, and second signal. Said sequences of first and second signals may be suitably mapped therefor in the reference sequence, for example by storing a binary string and/or list in the memory device, wherein one binary value may correspond to the first signal and another binary value to the second signal. It is also conceivable to store a time duration of the respective first and second signals in the reference sequence. The reference sequence can thus contain a kind of Morse code, so that time-resolved actuation patterns for the actuation of the locking device can also be represented by the reference sequence or mapped therein.

According to one embodiment, the reference sequence is configured so as to be elevator installation-specific.

The reference sequence is advantageously elevator installation-specific, e.g. individually dependent on an individual identification, e.g., a serial number of an elevator installation or installation data, and can be stored in the memory device. This stored reference sequence may be retrieved or otherwise acquired by personnel in order to perform maintenance work. As a result, the safety measures for personnel in installation or maintenance work can be further improved.

Furthermore, the reference sequence can be prevented from being misused, should it become unintentionally publicly known. Maintenance personnel may extract the reference sequence, e.g., at a suitable, non-publicly accessible location from the elevator installation, or can query the reference sequence from a central database.

The reference sequence may furthermore be time-specific, e.g. change after a certain time interval and/or be valid only for a certain period of time after a first input. Furthermore, the reference sequence can be determined for a certain, absolutely definable period, e.g. specified by date and/or time.

According to one embodiment of the invention, the controller is configured to take into account only those first signals and/or second signals which last at least 0.1 seconds and at most 10 seconds, for example, at least 0.3 seconds and at most 2.2 seconds, preferably, at least 0.5 seconds and no more than 2.0 seconds. The controller may be configured to discard first and/or second signals that are shorter and/or longer than the specified intervals.

The specified lower limits of the intervals can denote and/or represent a time resolution of the controller with which the controller can receive and/or take into account a first and/or second signal. For example, the locking device may comprise a sensor element, such as an electro-mechanical switch, which can oscillate between a locked and an unlocked state in a short time interval after mechanical actuation of the locking device, wherein a rapidly-oscillating and periodically alternating sequence of first and second signals can be generated. Such behavior of an electromechanical switch is known as bouncing. In order to advantageously be able to distinguish such bounce signals from actual actuation of the locking device performed by personnel, or to be able to disregard these bouncing signals, the time resolution of the controller may be selected, as indicated above by the lower limits of the respective intervals.

Furthermore, the locking device can be opened and closed—i.e., locked and unlocked—several times in succession as part of regular maintenance work, wherein such successive actuations of the locking device are usually delayed several seconds. In order to in turn advantageously be able to distinguish such signal sequences generated by regular actuation of the locking device from those signal sequences with which the maintenance mode is to be ended, the upper limits of the respective intervals may be selected as indicated above.

According to one embodiment of the invention, the controller is configured to take into account only those intermediate sequences of first signals and second signals which last between 0.1 seconds and 10 seconds, for example between 0.3 seconds and 2.2 seconds, preferably between 0.5 seconds and 2.0 seconds. The intermediate sequence comprises a chronological signal sequence of first signal, second signal, and first signal, or a chronological signal sequence of second signal, first signal, and second signal. Analogously to the above, bouncing signals and/or signal sequences generated by other actuation of the locking device can thus advantageously be distinguished from those signal sequences which are provided by the personnel in order to end the maintenance mode.

According to one embodiment of the invention, the controller is configured to release the car of the elevator installation only when at least two consecutive signal sequences of first signals and second signals each match the reference sequence. In other words, it may be provided that the personnel actuate the locking device at least twice in succession according to the reference sequence or according to the actuation pattern corresponding to the reference sequence. In this manner, a safety function provided by the control unit can advantageously be increased further.

Another aspect of the invention relates to an elevator-monitoring apparatus for monitoring a maintenance mode and/or a shaft inspection of an elevator installation. The elevator-monitoring apparatus has a control unit, as described above and below. Furthermore, the elevator-monitoring apparatus has a plurality of locking devices for a plurality of shaft doors of the elevator installation, wherein the locking devices each have at least one sensor element, which is respectively coupled to the controller of the control unit and which is configured in each case to generate the first signal in response to locking of the respective locking device and to generate the second signal in response to unlocking of the respective locking device.

In other words, a sensor element which can be configured to monitor an actuation state of the locking device can each be arranged on the shaft doors of the elevator installation or the locking devices thereof. The sensor elements may be connected in series, for example, as a safety chain of the elevator installation and coupled to the controller for signal propagation. The sensor elements may be, for example, coupled and/or connected in a cable-based manner and/or wirelessly to the controller. The sensor elements may actively convey and/or send the first and/or second signal to the controller. Alternatively or additionally, the controller may monitor a state of the sensor elements and thus pick up the first and/or second signals from the sensor elements.

According to one embodiment of the invention, the sensor elements of the locking devices each have at least one electro-mechanical switch. The locking device may, for example, comprise an electromechanical switch coupled to a lock of the shaft door, wherein the lock or the locking device can be locked and unlocked by the personnel with a corresponding key, such as a triangular key. Use of an electromechanical switch allows for the mechanical actuation of the locking device by the personnel to be advantageously converted into an electrical signal that can be processed by the controller. Furthermore, electro-mechanical switches can be characterized by a long life and low error rate. Alternatively or additionally, the sensor elements of the locking devices may each comprise a magnetic sensor, a Hall sensor, a radio frequency identification (RFID), and/or another type of sensor.

According to one embodiment of the invention, the controller of the control unit is coupled to a drive of a car of the elevator installation and to a safety chain of the elevator installation, wherein the safety chain comprises a plurality of safety switches, that are, for example, connected in series, wherein the safety switches are each coupled to at least one of the locking devices, and wherein the safety switches are each configured to interrupt the safety chain upon unlocking of the respective locking device. The controller is further coupled to at least one maintenance switch configured to indicate a maintenance mode of the elevator installation to the controller.

The safety switches of the safety chain may be part of the locking devices of the shaft doors. Upon opening of a shaft door or unlocking of a locking device, the safety chain can be interrupted and the car can be prevented from traveling, for example by interruption of a power supply to the drive. The controller may be coupled and/or connected in a cable-based manner and/or wirelessly to the safety chain/the safety switches.

The maintenance switch may designate a switch which may be arranged within the elevator shaft next to one or more shaft doors. When the maintenance switch is activated, the elevator installation may be transferred to a maintenance mode, in which operation of the car can be blocked completely, or in which the car can only be moved between certain positions within the elevator shaft and/or between certain floors. The controller may be coupled and/or connected in a cable-based manner and/or wirelessly to the maintenance switches.

According to one embodiment of the invention, the controller is configured to block and/or prevent the driving of the car, e.g., by interrupting the power supply to the drive, when the maintenance switch is activated and/or when the safety chain is interrupted. Further, after activation of the maintenance switch and subsequent deactivation of the maintenance switch, the controller is configured to release the drive of the car only when the safety chain is fully closed, for example, when all safety switches of the safety chain are closed, and when the chronological signal sequence of first signals and second signals matches the reference sequence for the actuation of the locking devices that is stored in the memory device. Thus, safety of the elevator system can be increased in an advantageous manner, since it can be ensured with the safety chain closed that all shaft doors are locked, and since it can be ensured with the maintenance switch deactivated and with concordance of the signal sequence with the reference sequence that no more personnel are present in the elevator shaft.

According to one embodiment of the invention, the elevator-monitoring apparatus furthermore has at least one acoustic and/or optical signal generator which is coupled to the control unit of the controller, wherein the controller is configured to control the signal generator if the signal sequence of the first signals and second signals matches the reference sequence and/or if the signal sequence deviates from the reference sequence. The controller may control the signal generator so as to emit an acoustically and/or visually perceptible signal. In this way, for the personnel who actuate the locking device according to the operating pattern mapped in the reference sequence, an acoustic and/or visual feedback regarding the correctness of the actuation pattern can advantageously be given. The signal generator may have, for example, a loudspeaker and/or a signal lamp. The controller may alternatively or additionally also control the signal generator upon actuation of the maintenance switch, e.g. an inspection switch, and, by issuing an acoustically and/or visually perceptible signal, ask the personnel to actuate the locking device according to the actuation pattern.

According to one embodiment of the invention, the elevator-monitoring apparatus further comprises a device for storing and/or resetting the reference sequence in the memory device. In this manner, the reference sequence can advantageously be defined and/or changed.

According to one embodiment of the invention, the device for storing and/or resetting the reference sequence has at least one operating switch on an operating terminal and/or on a service terminal of the elevator installation. For example, the device for storing and/or resetting the reference sequence may have a switch on a landing operating panel (LOP), which can be actuated, in particular for resetting, for example, with a key. It is also conceivable that the reference sequence can be entered by inputting of a switching pattern on a LOP and thus stored in the memory device. Furthermore, for example, a box that can be closed and opened with a key, for example, a triangular key, and/or a case or a flap may be arranged in the vicinity of a shaft door, for instance, on a lowest floor, wherein a switch of the device for resetting the reference sequence can be arranged may be arranged in the box or the case or behind the flap. Furthermore, a menu item for storing and/or resetting the reference sequence may be provided on a service terminal of the elevator installation which can be operated by a member of service personnel.

Another aspect of the invention relates to a method for ending a maintenance mode of an elevator installation. The method comprises the step of multiple successive instances of actuation of a locking device of a shaft door of the elevator installation, wherein a first signal is generated upon locking of the locking device and a second signal is generated upon unlocking of the locking device, so that in the step of multiple successive instances of actuation of the locking device, a chronological signal sequence of first signals and second signals is generated. The multiple successive instances of actuation of the locking device may denote multiple successive instances of locking and unlocking of the locking device. The method furthermore comprises the step of comparing, with a control unit of the elevator installation, the chronological signal sequence of first signals and second signals with a reference sequence for actuating the locking device that is stored in the control unit. The method furthermore comprises the step of releasing, by the control unit, a car of the elevator installation for a driving operation if the chronological signal sequence of first signals and second signals matches the reference sequence.

The step of comparing the signal sequence with the reference sequence may further comprise a substep of processing and/or processing the first and/or second signals. Furthermore, the step of comparing may comprise the substep of storing the signal sequence in the memory device of the control unit.

According to one embodiment of the invention, the method further comprises the step of deactivating a maintenance switch of the elevator installation and closing a safety chain of the elevator installation prior to the step of multiple successive instances of actuation of the locking device. As described in detail above and below, after maintenance work, the personnel leave the elevator shaft, deactivate the maintenance switch, lock the shaft door so that the safety chain can be closed, and then actuate the locking device according to the operation pattern stored in the reference sequence, whereby the maintenance mode can be ended and regular travel operation can be started. This can advantageously increase the safety of the elevator installation.

According to one embodiment of the invention, the step of multiple successive instances of actuation of the locking device is carried out at least twice in succession, such that a first signal sequence of first signals and second signals and a second signal sequence of first signals and second signals are generated, wherein the step of comparing the signal sequence with the reference sequence comprises comparing the first signal sequence and the second signal sequence with the reference sequence. The car is released if the first signal sequence and the second signal sequence match the reference sequence. In other words, in order to further increase the safety, it may be provided that the personnel actuate the locking device at least twice in succession according to the actuation pattern defined in the reference sequence in order to end the maintenance mode.

Overall it shall be understood that the described steps of the method may be implemented in the control unit and/or the elevator-monitoring apparatus as programmed software modules, functional modules, and/or functions. However, it is also possible for these functional modules to be implemented, entirely or in part, as hardware.

It should be noted that some of the possible features and advantages of the control unit, the elevator-monitoring apparatus, and the method are described here with reference to different embodiments. A person skilled in the art recognizes that the features may be combined, adapted, or exchanged as appropriate in order to yield other embodiments of the present invention.

Embodiments of the present invention are described below with reference to the accompanying drawings, wherein neither the drawings nor the description are to be interpreted as limiting the present invention.

The drawings are only schematic and are not true to scale. Like reference signs refer in different drawings to like or analogous features.

DETAILED DESCRIPTION

Figure 1:
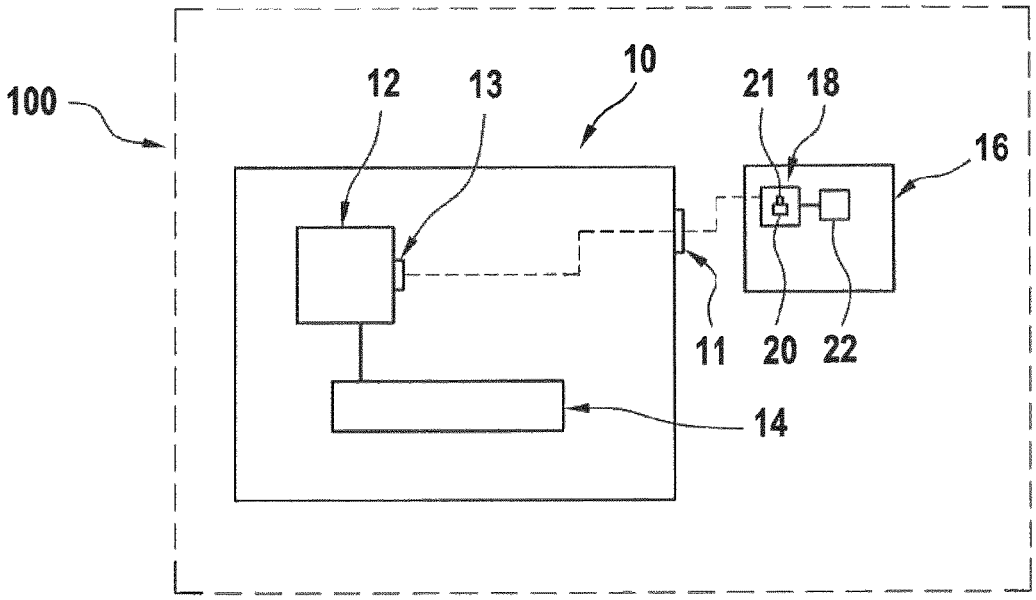
FIG. 1 illustrates a control unit for monitoring a maintenance mode of an elevator installation according to one embodiment of the invention.

FIG. 1 illustrates a control unit 10 for monitoring a maintenance mode and/or a shaft inspection of an elevator installation 100 according to one embodiment of the invention.

The control unit 10 has a controller 12 and a memory device 14. The controller 10 may have, for example, a logic device, a microcontroller, an FPGA, and/or another type of data processing device. The memory device 14 may refer to any device for storing and/or retrieving data, and may have, for example, a disk, a hard drive, a USB storage device, a RAM, a ROM, a FLASH memory, and/or an EROM.

The controller 12 is designed and, for example, set up with appropriate programming technology to receive a first signal when a locking device 18 of a shaft door 16 of the elevator installation 100 is locked and receive a second signal when the locking device 18 is unlocked. For this purpose, the control unit 10 may have a suitable interface 11 that may be coupled and/or connected to the locking device 18. Alternatively or additionally, the controller 12 itself may have a suitable interface 13 via which same may be coupled and/or connected to the locking device 18.

For the actual detection of an unlocking operation and/or a locking operation of the shaft door 16, the locking device 18 has a sensor element 20. The sensor element 20 may have, for example, an electromechanical switch 21, which may be coupled to a lock 22 of the shaft door 16 or the locking device 18. The lock 22 may be actuated, i.e., locked and unlocked, by personnel with a key, e.g. a triangular key. If the lock 22 is locked, then the sensor element 20 generates the first signal in response to the locking operation, and can transfer and/or send the first signal via the interface 11 and/or the interface 13 to the controller 12. Accordingly, the sensor element 20 may itself comprise a logic device. If the lock 22 and thus the locking device 18 and the shaft door 16 are unlocked, the sensor element 20 generates the second signal in response to the unlocking process and can transfer and/or send same via the interface 11 and/or the interface 13 to the controller 12.

Alternatively or additionally, the controller 12 may monitor and/or read out a state of the sensor element 20 and/or the locking device 18, so that the controller 12 can thus detect an actuation of the locking device 18. In turn, the controller 12 may further process the first and/or second signals received from the locking device 18 and/or the sensor element 20 of the locking device 18 and optionally deposit and/or store same in the memory device 14.

Monitoring of the maintenance mode with the control unit 10 according to the invention may be carried out as described below. If leaving the elevator shaft after maintenance work, the personnel can actuate the lock 22 and/or the locking device multiple times/alternate lock and unlock same, for example, with the triangular key. According to the invention, this multiple actuation of the locking device 18 is to take place in accordance with a defined pattern or actuation pattern. Multiple instances of actuation of the locking device 18 causes a chronological signal sequence and/or sequence of first and second signals to be generated via the sensor element 20 of the locking device 18. The signal sequence may then be an alternating sequence of first and second signals. The signal sequence can then be received by the controller 12 and compared with a reference sequence stored in the memory device 14, wherein the defined operation pattern is mapped and/or stored in the reference sequence. If the signal sequence matches the reference sequence, the controller 12 ends the maintenance mode of the elevator installation 100 and releases, for example, a car of the elevator installation for regular driving operation.

In principle, the reference sequence may represent any conceivable sequence of first and second signals. Also, in the reference sequence, a duration may be stored for certain positions of the sequence, similar to a Morse code. However, in order not to make the actuation pattern too complex for the personnel, it may be advantageous if the reference sequence is a chronological sequence of first signal, second signal, first signal, second signal, and first signal, or a chronological sequence of second signal, first signal, second signal, first signal, and second signal.

Furthermore, as described in detail above, in order to be able to distinguish, e.g. bouncing signals of the electro-mechanical switch 21 of the sensor element 20 and/or regular actuation operations of the locking device 18 during the maintenance work from those signal sequences that are generated according to the defined actuation pattern by the personnel in order to end the maintenance mode, it may be provided that the controller 12 considers only those first signals and/or second signals that last at least 0.1 seconds and at most 10 seconds, preferably at least 0.5 seconds and at most 2.0 seconds.

It may also be provided that the controller 12 takes into account only those intermediate sequences of first signals and second signals that last between 0.1 seconds and 10 seconds, preferably between 0.5 seconds and 2.0 seconds. The intermediate sequence may comprise a chronological signal sequence of first signal, second signal, and first signal, or a chronological signal sequence of second signal, first signal, and second signal.

In order to further increase the safety of the elevator installation 100, it may also be provided that the personnel operate the locking device 18 twice in succession in accordance with the predefined operating pattern. Thus, a first signal sequence and a second signal sequence, which can each be compared with the reference sequence, can be generated and be received by the controller 12. Accordingly, it may be provided that the first and second signal sequence should respectively match the reference sequence in order to end the maintenance mode and to release the car of the elevator installation 100.

Figure 2:
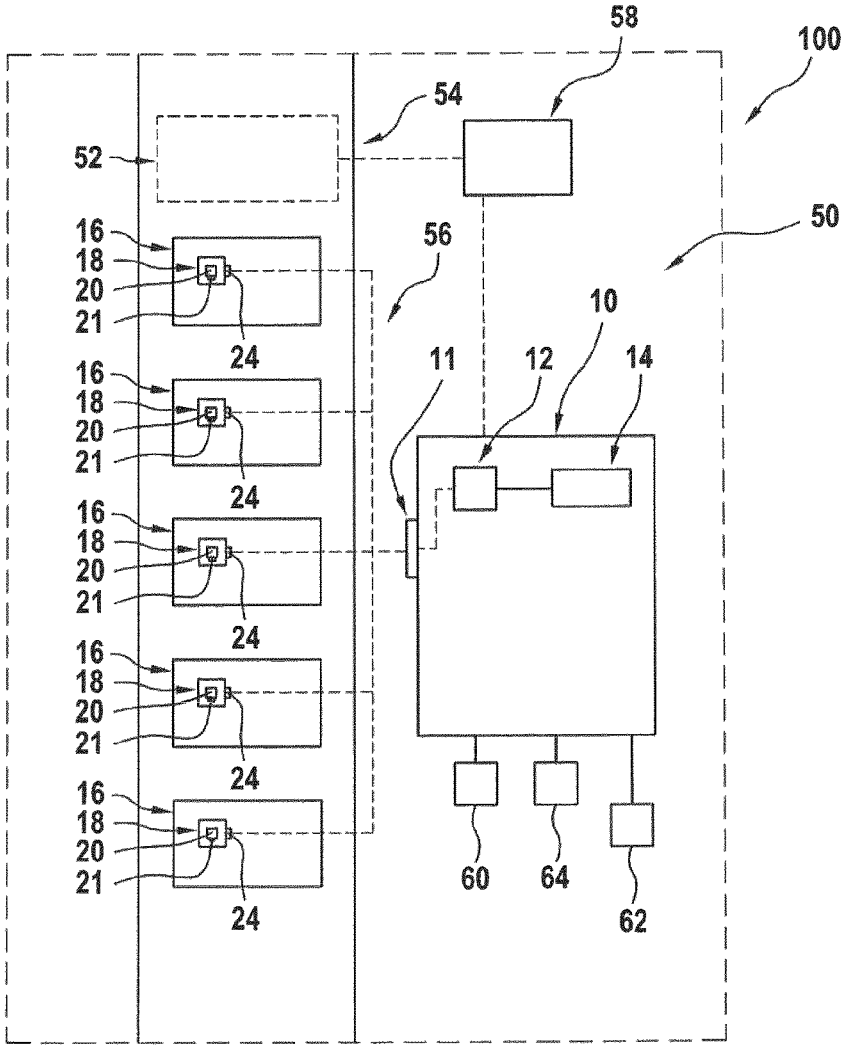
FIG. 2 illustrates an elevator-monitoring apparatus for monitoring a maintenance mode of an elevator installation according to one embodiment of the invention.

FIG. 2 illustrates an elevator-monitoring apparatus 50 having a control unit 10 for monitoring a maintenance mode of an elevator installation 100 according to one embodiment of the invention. Unless otherwise described, the elevator-monitoring apparatus 50 may have all of the features, functions, and characteristics described with FIG. 1.

The elevator-monitoring apparatus 50 has a control unit 10 with a controller 12 and a memory device 14 as well as a plurality of locking devices 18 for a plurality of shaft doors 16. The shaft doors 16 may be arranged approximately on different floors of a building, between which a car 52 can be moved in an elevator shaft 54 of the elevator installation 100. As described with FIG. 1, the locking devices 18 each have at least one sensor element 20 and/or one electro-mechanical switch 21, which are each coupled or connected to the control unit 10 and/or the controller 12. The sensor elements 20 are each configured to monitor an actuation state of the respective shaft door 16 and to generate the first signal when the respective locking device 18 is locked and the second signal when the respective locking device is unlocked, which signals can in turn be received by the control device 10 and/or the controller 12.

Furthermore, the control unit 10 and/or the controller 12 is coupled to a drive 58 of the elevator installation 100, which is configured to move the car 52 within the elevator shaft.

Further, the control unit 10 and/or the controller 12 is coupled to a safety chain 56 having a plurality of series-connected safety switches 24. The safety switches 24 may be provided by the locking devices 18 and/or the associated sensor elements 20 or the electro-mechanical switches 21. Also, additional safety switches 24 coupled to the locking devices 18 may be provided. The safety switches 24 are each configured to interrupt the safety chain 56 when one of the locking devices 18 is unlocked, and thus to prevent a driving operation of the car 52, for example, by interrupting a power supply to the drive 58.

Furthermore, the control unit 10 and/or the controller 12 is coupled and/or connected to at least one maintenance switch 60. For example, such a maintenance switch 60 may be arranged and/or provided on each floor within the elevator shaft 54 near each shaft door 16. Accordingly, the control unit 10 may be coupled to a plurality of maintenance switches 60.

The elevator-monitoring apparatus 50 further has an acoustic and/or optical signal generator 62, which is coupled to the controller 12 and/or the control unit 10. The signal generator 62 may have, for example, a loudspeaker and/or a signal lamp.

Monitoring of the maintenance mode with the aid of the elevator-monitoring apparatus 50 according to the invention may be carried out as described below. The personnel open one of the shaft doors 16 and unlock then one of the locking devices 18, whereby in turn one of the safety switches 24 and the safety chain 56 are opened. In response to the unlocked locking device 18 and/or the safety chain 56, the control unit 10/the controller 12 blocks and/or prevents the drive 58 of the elevator system 100 so that the car 52 can not be moved any more. The personnel can then enter the elevator shaft 52 and activate at least one of the maintenance switches 60, whereby the elevator installation can be put into the maintenance mode and the drive can be further blocked.

When leaving the elevator shaft 54 after the maintenance work, the personnel disable the maintenance switch 60 and lock the locking device 18, whereby the safety chain 56 can be closed again. According to the invention, the control unit 10 or the controller 12 furthermore prevents and/or blocks the drive until, analogously to the procedure described under FIG. 1, the personnel actuate the locking device 18 in accordance with the defined actuation pattern, whereupon the signal sequence of first and second signals is again generated and received by the controller 12. Only when the signal sequence matches the reference sequence stored in the memory device 14 does the control unit 10 or the controller 12 end the maintenance mode and release the drive 58 again, so that the car 52 can be moved in a regular driving operation. In other words, according to the invention, the maintenance mode is only ended when the safety chain 56 is completely closed, all maintenance switches 60 are deactivated, and the signal sequence matches the reference sequence. It may also be provided that the actuation pattern is to be input twice in succession by the personnel in order to end the maintenance mode. If the signal sequence matches the reference sequence, the control unit 10 and/or the controller 12 may also control the signal generator 62 in such a manner as to output an acoustic and/or visual confirmation signal as feedback for the personnel. Even if the signal sequence deviates from the reference sequence, the control unit 10 and/or the controller 12 may control the signal generator 62 in such a manner as to output an error signal as feedback for the personnel.

Furthermore, the elevator-monitoring apparatus 50 may optionally have a device 64 for storing and/or resetting the reference sequence in the memory device 14.

The device 64 for storing and/or resetting the reference sequence has at least one operating switch on an operating terminal and/or on a service terminal of the elevator installation. For example, the device 64 for storing and/or resetting the reference sequence may have a switch on a landing operating panel (LOP), which can be actuated, in particular for resetting, for example, with a key. It is also conceivable that the reference sequence can be entered by inputting of a switching pattern on a LOP and thus stored in the memory device 14. Furthermore, for example, a box that can be closed and opened with a key, for example, a triangular key, and/or a case or a flap may be arranged in the vicinity of a shaft door, for instance, on a lowest floor, wherein a switch of the device 64 for resetting the reference sequence can be arranged may be arranged in the box or the case or behind the flap. Furthermore, a menu item for storing and/or resetting the reference sequence may be provided on a service terminal of the elevator installation 100 which can be operated by a member of service personnel.

Figure 3:
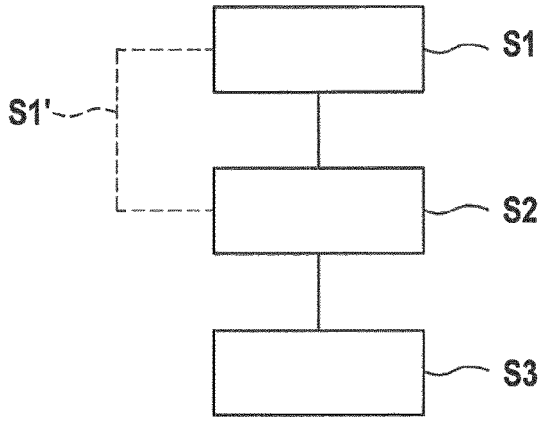
FIG. 3 illustrates a flow chart for illustrating steps of a method for ending a maintenance mode of an elevator installation according to one embodiment of the invention.

FIG. 3 illustrates a flow chart for illustrating steps of a method for ending a maintenance mode of an elevator installation 100 according to one embodiment of the invention.

The method has a step S1 of multiple successive instances of actuation of the locking device 18, which step may comprise multiple successive instances of locking and unlocking of the locking device 18. Thus, as described above, a chronological signal sequence of first signals and second signals, which is received by the control unit 10 and/or the controller 12, is generated.

Optionally, the step S1 may comprise a substep of deactivating the maintenance switch 60 of the elevator installation 100 and/or closing the safety chain 56 of the elevator installation 100 before the multiple successive actuation operating the locking device 18.

The method furthermore comprises a step S2 of comparing, with the control unit 10 and/or the controller 12, the chronological signal sequence of first signals and second signals with the reference sequence for actuating the locking device 18 that is stored in the memory device 14 of the control unit 10. Optionally, the step S2 of comparing may comprise a substep of the controlling, through the control unit 10 and/or the controller 12, the signal generator 64 if the signal sequence and the reference sequence match and/or deviate. Alternatively or additionally, the step S2 of comparing may comprise a substep of outputting a confirmation signal via the signal generator 64 and/or outputting an error signal via the signal generator 64.

Furthermore, it may optionally be provided that, after the step S2, the locking device 18 is repeatedly and successively actuated according to the actuation pattern again, in another step S1', so as to generate a further signal sequence, which in turn can be compared with the reference sequence, analogously to step S2. Optionally, in turn, it may be provided that the signal generator 64 is controlled again to output the confirmation signal and/or the error signal.

The method furthermore comprises a step S3 of releasing, by the control unit 10 and/or the controller 12, the car 52 of the elevator installation 100 for a driving operation if the chronological signal sequence of first signals and second signals matches the reference sequence. If the step S1 comprises deactivating the maintenance switch 60 and/or closing the safety chain 56, then in step S3 it may be provided that the car 52 is only released when the maintenance switch 60 is deactivated, the safety chain 56 is closed, and the signal sequence matches the reference sequence.

In general, the method may be carried out as described below during maintenance work on an elevator installation 100. For maintenance work, the personnel can access the elevator shaft 54 via one of the shaft doors 16 and/or via a maintenance hatch.

If the personnel enter the elevator shaft 54 via the shaft door 16, it may be ensured that the car 52 is not at a base terminus of the elevator installation 100. The personnel can unlock the locking device 18 and open the shaft door 16, whereby the safety chain 56 can be interrupted. The car 52 may then remain stationary. The personnel can make sure that the car 52 is stationary. The personnel may activate a light switch of the elevator shaft 54 and the maintenance switch 60. The elevator installation 100 can then switch to a rest or stop state or the maintenance mode, whereupon the safety chain 56 remains interrupted and door movement can be prevented as long as the maintenance switch 60 is activated. The personnel can then enter the elevator shaft 54, for example via a ladder, and, if necessary, close the shaft door 16 again and lock the locking device 18. The safety switch 24 of the safety chain 56 on the corresponding shaft door 16 can be closed thereby, but the safety chain 56 remains interrupted when the maintenance switch 60 is activated. After the maintenance work, the personnel can open the shaft door 16 again and unlock the locking device 18 again. The associated safety switch 24 is opened and the drive 58 of the elevator car 52 can remain blocked. The personnel can exit elevator shaft 54, deactivate the light switch and the maintenance switch 60, close the shaft door 16 again, and lock the locking device 18. The safety chain 56 can thereby be completely closed, but the drive 58 remains blocked. The personnel may then operate the locking device 18 once or twice according to the operation pattern, which may be recognized by the control unit 10 and/or the controller 12. If the generated signal sequence or signal sequences match(es) the reference sequence, the drive 58 can be released again, the elevator installation 100 can optionally carry out a correction and/or test drive and then resume the regular driving operation.

If the personnel enter the elevator shaft 54 via the service hatch, it can be opened and/or unlocked. The maintenance hatch may then itself have a safety switch or not be coupled to the safety chain 56. If the maintenance hatch has a safety switch, the safety chain 56 is interrupted in the same way as described above when the maintenance hatch is opened, and the drive 58 is blocked. The personnel can enter the elevator shaft 54, activate the light switch and the maintenance switch 60, thereby placing the elevator installation 100 in the rest or stop state or the maintenance mode. The personnel enters the elevator shaft 54 and closes the maintenance hatch, whereby—if present—the safety switch can be closed. The drive 58 remains blocked again when the maintenance switch 60 is activated. After the maintenance work, the personnel re-open the maintenance hatch, whereby the safety switch—if present—can opened again. The personnel can deactivate the light switch and the maintenance switch 60 and close and/or lock the maintenance hatch again, whereby the safety chain 56 can be closed. However, the drive 58 can remain blocked. The personnel may go to one of the shaft doors 16 and actuate the interlocking device 18 once or twice according to the actuation pattern, which can be recognized by the control unit 10 and/or the controller 12. If the generated signal sequence or signal sequences match(es) the reference sequence, the drive 58 can be released again, the elevator installation 100 can optionally carry out a correction and/or test drive and then resume the regular driving operation.

Finally, it should be noted that terms such as "comprising" and the like do not preclude other elements or steps, and terms such as "a" or "one" do not preclude a plurality. Furthermore, it should be noted that features or steps that have been described with reference to one of the above embodiments may also be used in combination with other features or steps of other embodiments described above.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE SIGNS

10 Control unit
11 Interface
12 Controller
13 Interface
14 Memory device
16 Shaft door
18 Locking device
20 Sensor element
21 Switch
22 Lock
24 Safety switch
50 Elevator-monitoring apparatus
52 Car
54 Elevator shaft
56 Safety chain
58 Drive
60 Maintenance switch
62 Signal generator
64 Device for storing/resetting the reference sequence
100 Elevator installation

The invention claimed is:

1. A control unit for monitoring a maintenance mode of an elevator installation, comprising:

a controller;

a memory device connected to the controller, wherein the controller receives a first signal when a locking device of a shaft door of the elevator installation, whereby an elevator shaft of the elevator installation is accessible via the shaft door for maintenance work, is locked and receives a second signal when the locking device is unlocked;

wherein the controller disregards ones of the first and second signals that last less than a lower limit predetermined time thereby distinguishing from bounce signals to identify a chronological signal sequence of the first and second signals;

wherein the controller compares the chronological signal sequence of at least two of the first signal received and at least two of the second signal received with a reference sequence stored in the memory device for actuation of the locking device, wherein the reference sequence is specific to the elevator installation by being retrievable from the memory device for comparison with the one chronological signal sequence dependent on an individual identification of the elevator installation; and wherein the controller ends the maintenance mode and releases a car of the elevator installation for a driving operation in response to the one chronological signal sequence matching the reference sequence.

2. The control unit according to claim 1 wherein the reference sequence comprises a chronological sequence of the first signal, the second signal, the first signal, the second signal, and the first signal, or wherein the reference sequence comprises a chronological sequence of the second signal, the first signal, the second signal, the first signal, and the second signal.

3. The control unit according to claim 1 wherein the controller includes in the chronological signal sequence only those of the first signal which last at least 0.1 seconds and at most 10 seconds, or only those of the second signal which last at least 0.1 seconds and at most 10 seconds, or only those of both the first signal and the second signal which last at least 0.1 seconds and at most 10 seconds.

4. The controller according to claim 1 wherein the controller includes in the chronological signal sequence only intermediate sequences of the first signal and the second signal that last between 0.1 seconds and 10 seconds, and wherein each of the intermediate sequences is a chronological sequence of the first signal, the second signal, and the first signal, or a chronological sequence of the second signal, the first signal, and the second signal.

5. The control unit according to claim 1 wherein the controller releases the car only when at least two consecutive chronological signal sequences of the first signals and the second signals each match the reference sequence.

6. An elevator-monitoring apparatus for monitoring a maintenance mode of an elevator installation including a control unit according to claim 1, comprising:

a plurality of locking devices for a plurality of shaft doors respectively, of the elevator installation; and wherein the locking devices each have at least one sensor element, each of the sensor elements being coupled to the controller of the control unit and being adapted to generate the first signal in response to locking of the respective locking device and to generate the second signal in response to unlocking of the respective locking device.

7. The elevator-monitoring apparatus according to claim 6 wherein the sensor elements of the locking devices each have at least one electro-mechanical switch for generating the first signal and the second signal.

8. The elevator-monitoring apparatus according to claim 6 wherein the controller is coupled to a drive of the car and to a safety chain of the elevator installation, wherein the safety chain has a plurality of safety switches, wherein the safety switches are each coupled to at least one of the locking devices, wherein the safety switches each interrupt the safety chain when the associated locking device is unlocked, and wherein the controller is further coupled to at least one maintenance switch to indicate a maintenance mode of the elevator installation to the controller.

9. The elevator-monitoring apparatus according to claim 8 wherein the controller blocks the drive of the car when at least one of the at least one maintenance switch is activated and the safety chain is interrupted, and wherein the controller releases the drive of the car after activation of the at least one maintenance switch and subsequent deactivation of the at least one maintenance switch only when the safety chain is completely closed and the chronological signal sequence matches the reference sequence for the actuation of the locking device that is stored in the memory device.

10. The elevator-monitoring apparatus according to claim 6 including a signal generator being at least one of an acoustic generator and an optical generator that is coupled to the controller of the control unit, and wherein the controller controls the signal generator in response to at least one of the chronological signal sequence matches the reference sequence and the chronological signal sequence deviates from the reference sequence.

11. The elevator-monitoring apparatus according to claim 6 including a device for at least one of storing and resetting the reference sequence in the memory device.

12. The elevator-monitoring apparatus according to claim 11 wherein the device for at least one of storing and resetting the reference sequence has at least one operating switch on an operating terminal or on a service terminal of the elevator installation.

13. A method for ending a maintenance mode of an elevator installation, the method comprising the steps of:

in response to multiple successive instances of actuation of a locking device of a shaft door of the elevator installation, generating a chronological signal sequence of at least two first signals and at least two second signals, wherein the first signals are generated upon locking of the locking device and the second signals are generated upon unlocking of the locking device;

disregarding ones of the first and second signals that last less than a lower limit predetermined time when generating the chronological signal sequence thereby distinguishing from bounce signals;

comparing, with a control unit of the elevator installation, the chronological signal sequence with a reference sequence for actuating the locking device that is stored in the control unit, wherein the reference sequence is specific to the elevator installation by being retrievable from a memory device of the control unit for the comparing with the chronological signal sequence dependent on an individual identification of the elevator installation; and releasing, by the control unit, of a car of the elevator installation for a driving operation in response to the chronological signal sequence matching the reference sequence.

14. The method according to claim 13 including a step of deactivating a maintenance switch of the elevator installation and closing a safety chain of the elevator installation prior to the multiple successive instances of actuation of the locking device.

15. The method according to claim 13 wherein the multiple successive instances of actuation of the locking device is carried out at least twice in succession, such that a first signal sequence of the first signals and the second signals and a second signal sequence of the first signals and the second signals are generated, wherein the step of comparing compares the first signal sequence and the second signal sequence with the reference sequence, and wherein the car is released in response to the first signal sequence and the second signal sequence matching the reference sequence.

16. A method for ending a maintenance mode of an elevator installation, the method comprising the steps of:

in response to multiple successive instances of actuation of a locking device of a shaft door of the elevator installation, generating a chronological signal sequence of first signals and second signals, wherein the first signals are each generated upon locking of the locking device and the second signals are each generated upon unlocking of the locking device;

wherein the chronological signal sequence includes only those of the first signals which last at least 0.1 seconds and at most 10 seconds, or only those of the second signals which last at least 0.1 seconds and at most 10 seconds, or only those of both the first signals and the second signals which last at least 0.1 seconds and at most 10 seconds, and does not include ones of the first and second signals that last less than 0.1 second thereby distinguishing from bounce signals;

wherein the chronological signal sequence includes only intermediate sequences of the first signals and the second signals, and wherein each of the intermediate sequences is a chronological sequence of one of the first signals, one of the second signals, and another of the first signals, or a chronological sequence of one of the second signals, one of the first signals, and another of the second signals;

comparing, with a control unit of the elevator installation, the chronological signal sequence with a reference sequence for actuating the locking device that is stored in the control unit; and releasing, by the control unit, of a car of the elevator installation for a driving operation in response to the chronological signal sequence matching the reference sequence.

17. The method according to claim 16 wherein the control unit releases the car only when at least two consecutive chronological signal sequences of the first signals and the second signals each match the reference sequence.

18. The method according to claim 13 including storing a predetermined time duration of each of the first and second signals in the reference sequence and comparing the chronological signal sequence with the reference sequence on a time-resolved actuation pattern basis.

19. The method according to claim 1 including storing a predetermined time duration of each of the first and second signals in the reference sequence and comparing the chronological signal sequence with the reference sequence on a time-resolved actuation pattern basis.

* * * * *